United States Patent [19]

Sehulster et al.

[11] 4,131,408

[45] Dec. 26, 1978

[54] MACHINE FOR MAKING DRY CAST CONCRETE PIPE

[76] Inventors: Joseph P. Sehulster, 14830 San Marcos Dr., Brookfield, Wis. 53005; Stephen N. Halbach, 48 Merrill St., Nashua, Iowa 50658; Darrell Haar, 444 Lee Ave., Woodstock, Ontario, Canada, N4S 643; Theron L. Crawford, 20501 W. Downie Rd., New Berlin, Wis. 53151

[21] Appl. No.: 821,540

[22] Filed: Aug. 3, 1977

[51] Int. Cl.[2] ..... B28B 21/12

[52] U.S. Cl. ..... 425/410; 425/414; 425/421; 425/423; 425/432; 425/438

[58] Field of Search ..... 249/100; 425/262, 414, 425/421, 423, 432, 438, 361, 410

[56] References Cited

U.S. PATENT DOCUMENTS

| | | | |
|---|---|---|---|
| 3,141,222 | 7/1964 | Steiro | 425/262 |
| 3,343,236 | 9/1967 | Helms | 425/432 |
| 3,922,133 | 11/1975 | Crawford et al. | 425/262 |

*Primary Examiner*—Francis S. Husar
*Assistant Examiner*—John McQuade
*Attorney, Agent, or Firm*—Burd, Braddock & Bartz

[57] ABSTRACT

A machine for making a dry cast concrete pipe. The machine has a cross head carrying a rotatable shaft extended downwardly into a core supported on a turntable. An outer form mounted on the turntable surrounds the core. A head attached to the lower end of the shaft is engageable with the core to raise the core out of the outer form in response to upward movement of the cross head. Arms secured to the shaft above the core rotate with the shaft to move concrete from the top of the core into the annular chamber between the core and outer form. An annular press ring mounted on a top table is moved into the top area of the annular chamber to compact concrete before the core is withdrawn from the outer form.

47 Claims, 7 Drawing Figures

37
43
28
27
101
103
102
93
44
63
61
77
78
89
104
27
91
92
62
64
81
59
100
50
18
17
52
113
56
39
34
53
41
83
42
57
109
51
4
4
58
114
54
86
86
31
29
112
69
84
68
84
87
67
71
66
87
88
21
72
76
73
74
21

FIG. 5
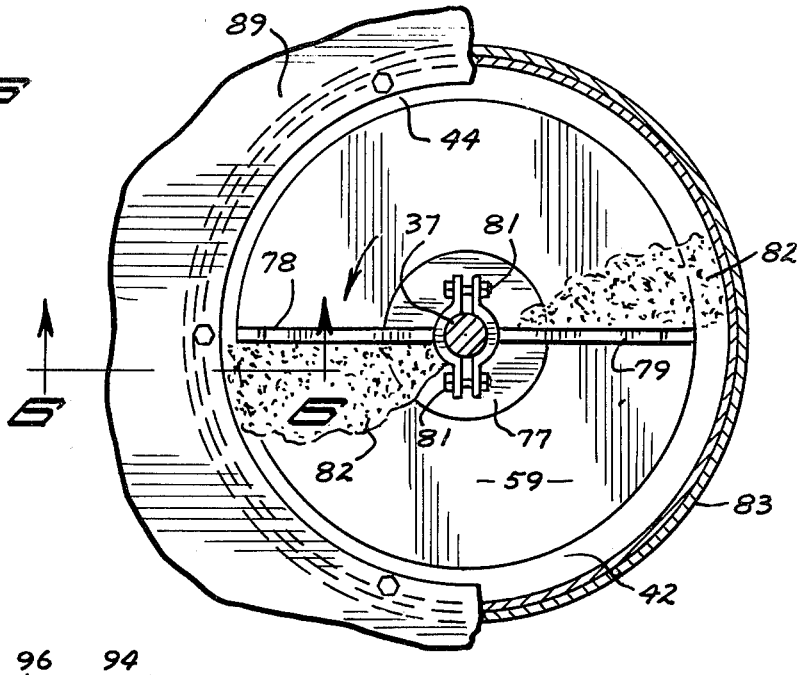
FIG. 6
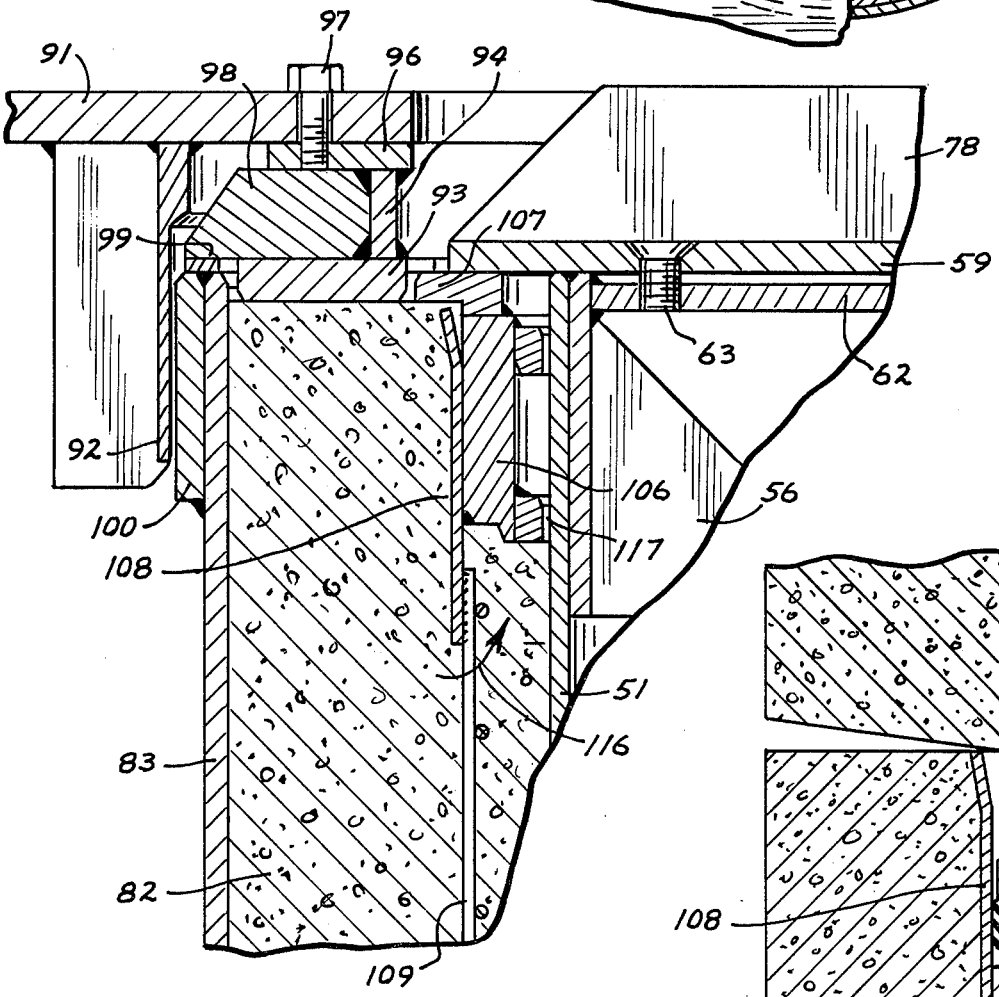
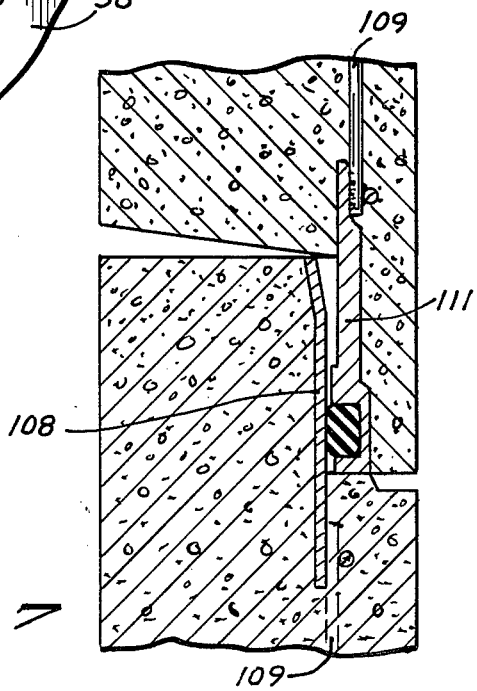
FIG. 7

MACHINE FOR MAKING DRY CAST CONCRETE PIPE

BACKGROUND OF INVENTION

Dry cast systems are used to make concrete products, as concrete pipes, box culverts, manhole cones, and median barriers. These systems use an outer form surrounding a bottom pallet. An inner core is moved up into the outer form as concrete is fed into the outer form above the core. A rotating distributor on top of the core moves concrete into the space between the core and outer form. Vibrators vibrate the core to consolidate the concrete. The core is then withdrawn from the concrete product. The outer form and product is transported to a curing area where the outer form is shipped from the product. The empty form can be placed over another cage and pallet and returned to the machine to begin a new cycle.

PRIOR ART

U.S. Pat. No. Re. 28,902; Trautner et al.
U.S. Pat. No. 2,015,001; Bishop
U.S. Pat. No. 3,262,175; Gourlie et al.
U.S. Pat. No. 3,419,649; Livingston et al.
U.S. Pat. No. 3,461,516; Boucher
Swiss Pat. No. 329,666; Olsson et al.

SUMMARY OF INVENTION

The invention is directed to a machine for making dry cast concrete product, as pipes, culverts, manhole structures, and the like. The machine has a cross head mounted for movement between down and up positions. A shaft attached to the cross head extends downwardly into a core. Drive means on the cross head rotates the shaft. An outer form surrounds the core providing a chamber for accommodating concrete. The core and form are supported on a turntable so that the shaft can be rotated without rotating the core. A conveyor delivers concrete to the top of core. Distributor arms fastened to the shaft above the core move concrete off the top of the core into the chamber between the core and outer form. Vibrators mounted on the core densify the concrete during the forming of the pipe. After the chamber is filled, the concrete at the upper end of the pipe is compressed with an annular press ring. The press ring is mounted on a top table that moves with the cross head. The cross head is then moved from the lower to the raised position thereby raising the shaft and drawing the core out of the concrete pipe and outer form. The concrete pipe and outer form is transported to a curing location where the outer form is stripped from the pipe. The outer form is placed over a new pallet and cage and returned to the machine to make another concrete pipe.

An object of the invention is to provide a machine for making a dry cast concrete pipe having a cross head connected to a core with a shaft operable to withdraw the core from a concrete pipe formed about the core. Another object of the invention is to provide a dry cast concrete pipe making machine with a rotatable shaft carrying concrete distributor arms above a core for moving concrete from the top of the core into a chamber around the core. A further object of the invention is to provide a dry cast concrete pipe making machine with a movable press ring operable to compress concrete in the upper end of the pipe before the core is withdrawn from the pipe. Yet another object of the invention is to provide a machine for making dry cast concrete product having a uniform and dense concrete body, as the wall of a concrete pipe. Still another object of the invention is to provide a machine for making a concrete pipe in which the concrete in the female end of the pipe has been compressed to minimize the voids in the end of the pipe. These and other objects and advantages of the apparatus for making dry cast concrete products are embodied in the apparatus hereinafter shown and described.

IN THE DRAWINGS

FIG. 5 is an enlarged top view, partly sectioned, of the core positioned in the jacket;

FIG. 6 is an enlarged sectional view taken along line 6—6 of FIG. 5; and

FIG. 7 is a sectional view showing adjacent ends of concrete pipes assembled together.

DESCRIPTION OF PREFERRED EMBODIMENT

Figure 1:
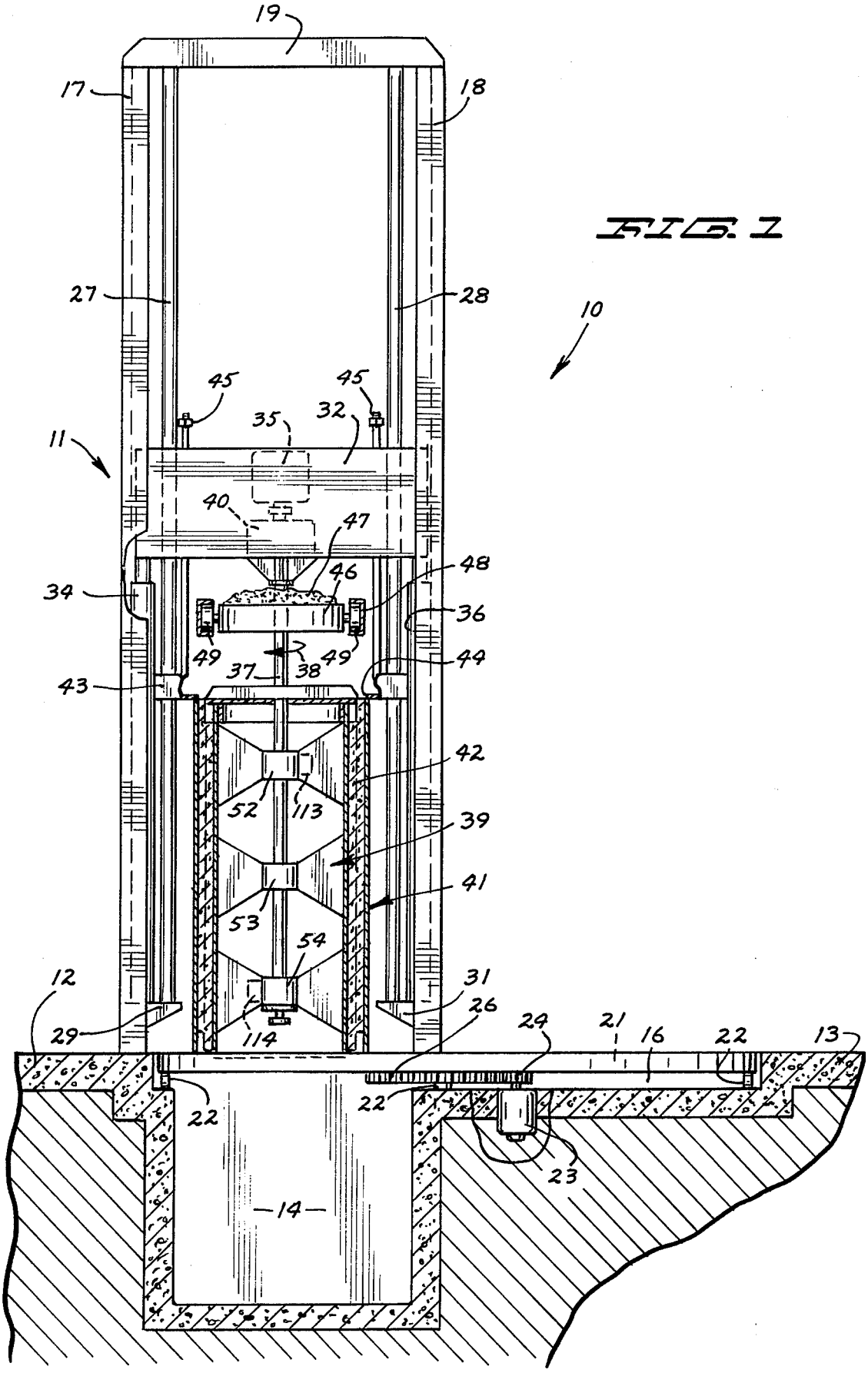
FIG. 1 is a front elevational view, partly sectioned, of a machine for making dry cast concrete pipe embodying the structure of the invention.

Referring to the drawings, FIG. 1 shows a machine indicated generally at 10 for making dry cast concrete product, as a concrete pipe, culvert, manhole structures, and the like. Machine 10 has an upright frame 11 secured to a base or support 12. Support 12 is a concrete floor 13 containing a pit 14 and shelf recess 16. A second pit can be located adjacent pit 14 under turntable 21. Frame 11 has two front upright posts 17 and 18. The upper end of posts 17 and 18 are secured to a cross beam 19.

A circular turntable 21 surrounds post 18 and extends over pit 14 and shelf space 16. A plurality of rollers or wheels 22 support turntable 21 on floor 13. Turntable 21 has a first portion between posts 17 and 18 defining a station wherein concrete pipe is formed. The remaining or second portion of turntable 21 is spaced from posts 17 and 18 allowing the pipe and outside jacket to be removed from turntable 21 with carrier or transport vehicles to a curing area. Turntable 21 is rotated or indexed by operation of a motor 23. Motor 23 is connected to a drive gear 24 located in driving engagement with a driven gear 26 connected to turntable 21. Other types of drive mechanisms can be used to index turntable 21.

Figure 2:
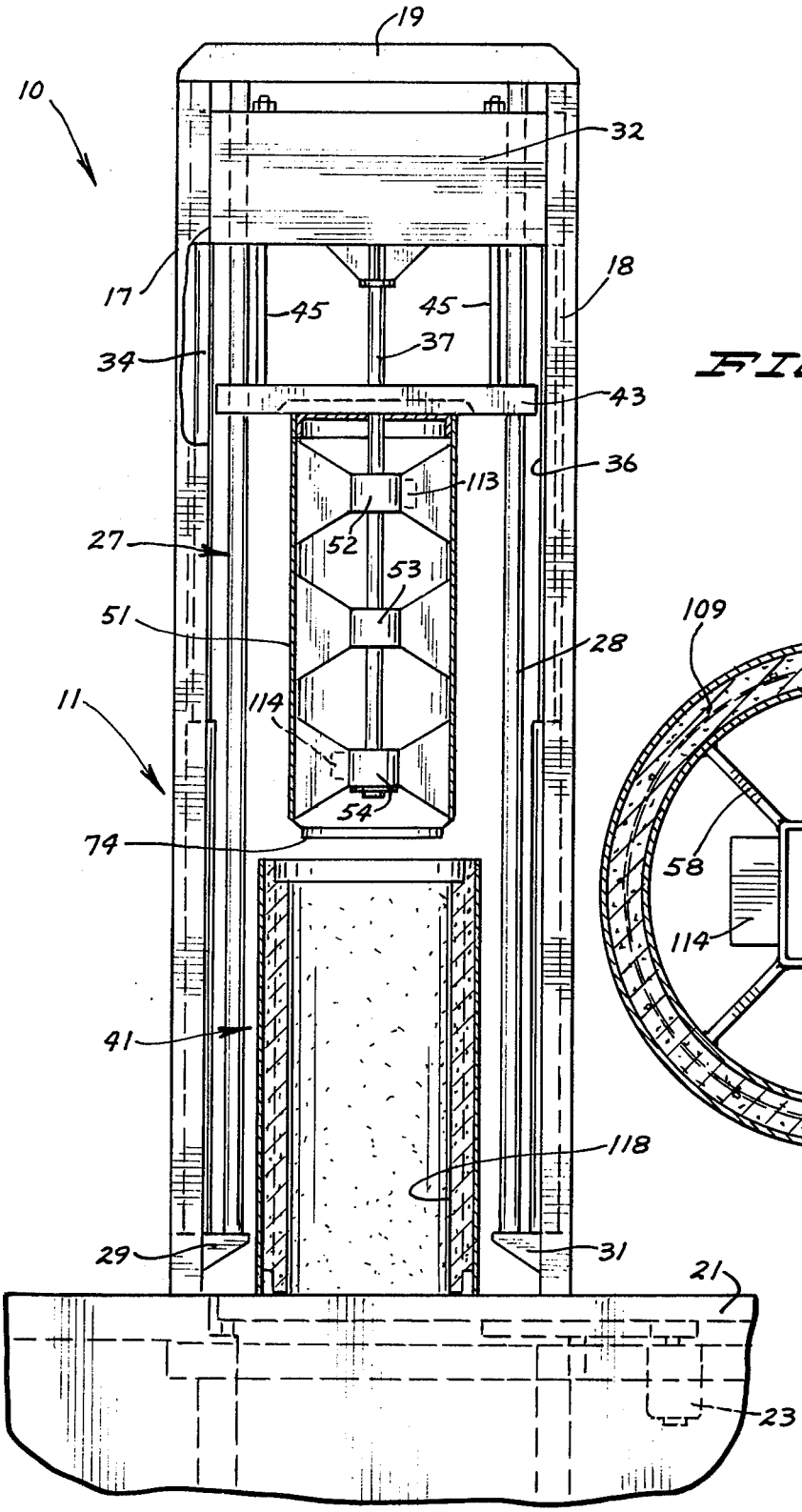
FIG. 2 is a front elevational view similar to FIG. 1 showing the machine with the cross head holding the core in the up position.
Figure 4:
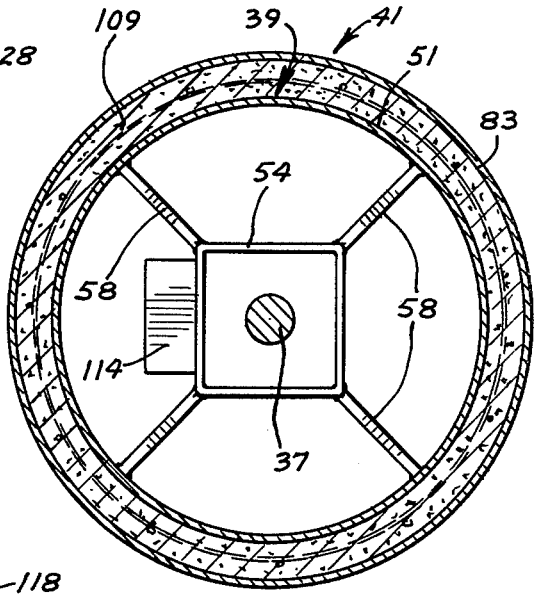
FIG. 4 is a sectional view taken along the line 4—4 of FIG. 3.

A pair of upright cylindrical guide members 27 and 28 are located adjacent the inside portions of posts 17 and 18. Guide members 27 and 28 extend downwardly from cross member 19 to brackets 29 and 31 secured to the lower end of posts 17 and 18. A cross head 32 is movably mounted on guide members 27 and 28 for movement in a general vertical or up and down direction. A pair of elongated hydraulic cylinders 34 and 36 having telescopic cylindrical members operable to move cross head 32 from its lower or down position, shown in FIG. 1, to its raised or up position, as shown in FIG. 2. The upper end of cylinder 34 is connected to one end of cross head 32 and the lower end is mounted on bracket 29. Cylinder 36 is located between post 18 and guide member 28 and is connected to the other end of cross head 32 and bracket 31. Cylinders 34 and 36 are connected to a source of hydraulic fluid under pressure through suitable controls (not shown) used to control the operation of the machine.

A downwardly directed shaft 37 is mounted on the center portion of cross head 32. Cross head 32 has a motor 35 and gear box or power transmitting structure 40 operable to rotate shaft 37, as indicated by arrow 38. Shaft 37 extends downwardly along the longitudinal upright axis of a cylindrical core indicated generally at 39. An outer form or cylindrical jacket 41 is concentrically disposed about core 39. Jacket 41 is radially spaced from the core to form an annular chamber or space 42 for accommodating concrete to make the dry cast concrete pipe.

A horizontal top table 43 movably mounted on guide members 27 and 28 is located adjacent the upper end of core 39 and jacket 41. Top table 43 has a large central opening 44 providing access to the top of annular chamber 42. A plurality of lifting rods 45 connect top table 43 with cross head 32 whereby upward movement of cross head 32 will also raise top table 43, as shown in FIG. 2. A conveyor 46 located above top table 43 functions to move concrete 47 from a hopper (not shown) to the area above the top of core 39. Conveyor 46 is movably mounted on track structure 48 so that it can be moved toward and away from shaft 37. Rollers 49 or similar support structures movably mount the conveyor 46 on the track structure 48. An example of hopper and conveyor structure for moving concrete to the center area of top table 43 is disclosed by Gill in U.S. Pat. No. 3,829,268.

Figure 3:
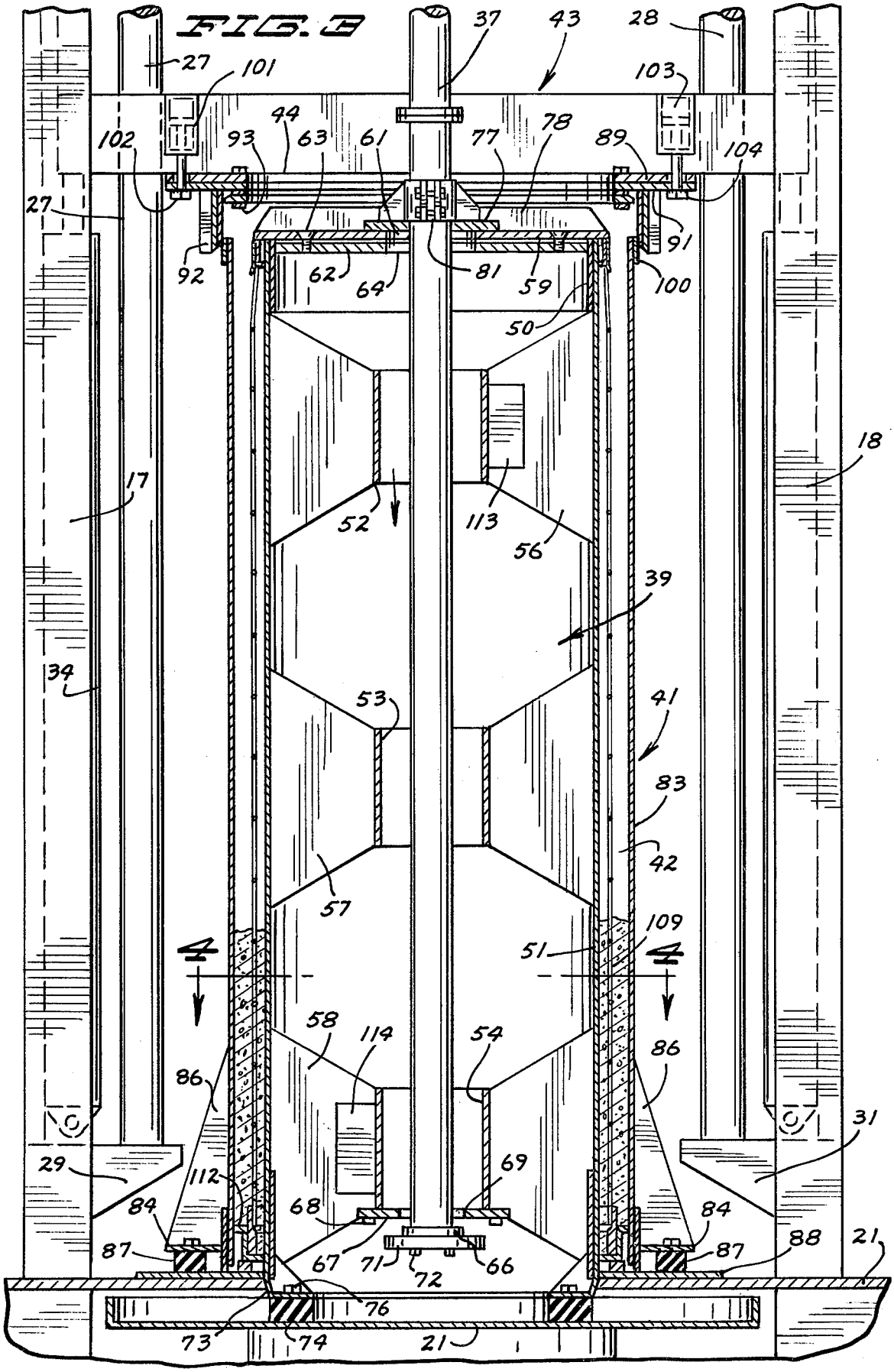
FIG. 3 is an enlarged elevational view of the lower portion of the machine of FIG. 1 with the core and jacket shown in section.

As shown in FIG. 3, core 39 has an upright cylindrical outside wall 51 extended from turntable 21 to top table 43. Three tubular box-shaped members 52, 53, and 54 are axially aligned relative to each other along the longitudinal center line of wall 51. Four reinforcing gusset plates 56 secure the corners of box-shaped member 52 to the adjacent inside surface of wall 51. Four gusset plates 57 secure the corners of the box-shaped member 53 to the center portion of the inside of wall 51. In a similar manner, four gusset plates 58 secure the corners of the box-shaped member 54 to lower end portions of the inside wall 51. As shown in FIG. 3, top of core 39 is closed with a flat top plate 59 having a central hole 61 in longitudinal alignment with the passages through tubular box members 52, 53, and 54. An annular flat ring member 62 located below plate 59 is secured to the wall 51 with a sleeve 50. A plurality of fasteners 63 secure plate 59 to ring member 62. Annular member 62 has a central hole 64 aligned with hole 61.

As shown in FIG. 3, shaft 37 extends downwardly through holes 61 and 64 and the passages in the box-shaped members 52, 53, and 54. A head 66 or an outwardly directed cylindrical flange is secured to the lower end of shaft 37. A ring or collar 67 having a central hole 69 for accommodating shaft 37 is secured to the lower end of box member 52 with a plurality of fasteners 68. A circular plate 71 is mounted on the bottom of head 66 with a plurality of fasteners 72, as bolts. Head 66 has a diameter smaller than hole 69. Plate 71 has a diameter larger than hole 69 so that plate 71 will contact collar 67 when shaft 37 is raised. Head 66 and plate 71 are spaced below collar 67 when core 39 is resting on turntable 21 so that shaft 37 is free to rotate without turning core 39.

Core 39 has an annular base 73 secured to the lower end of cylindrical wall 51. Base 73 is secured to an annular resilient ring or cushion 74 supported on turntable 21. A plurality of fasteners 76 secure ring 74 to the bottom of base 73.

As shown in FIGS. 3 and 5, an annular cover plate 77 surrounds shaft 37 above top plate 59. A pair of radial distributor arms 78 and 79 are clamped to shaft 37 with a plurality of nut and bolt assemblies 81. Arms 78 and 79 are flat blades that extend radially from shaft 37 to the outer circular edge of top plate 59. Arms 78 and 79 turn with shaft 37 to move concrete 82 from plate 77 into the annular chamber 42 formed by core 39 and outer jacket 41.

Outer jacket 41 has a cylindrical upright wall 83 having a diameter larger than the diameter of the core wall 51. Circumferentially spaced around the lower end of wall 83 is a plurality of outwardly directed members or feet 84. Upright triangular braces or gusset plates 86 secure the members 84 to a portion of the lower end of wall 83. Resilient blocks 87 are attached to the lower sides of members 84. Blocks 87 rest on a filler plate 88 attached to the top of turntable 21.

Top table or platform 43 has a horizontal floor 89 located above a movable annular plate or ring 91. A downwardly directed cylindrical member or sleeve 92 secured ring 91 surrounds the upper portion of the outer jacket 83. As shown in FIG. 3 and 6, a flat annular press ring 93 is located around the inner side of the cylindrical member 92. An upright rib 94 is connected to an annular member 96 to space the press ring 93 below ring 91. A plurality of fasteners 97, such as bolts, secure the member 96 to the bottom of ring 91. A plurality of circumferentially spaced stop members 98 are located between the press ring 93 and member 96. Stops 98 have outwardly directed tabs or shoulders 99 that engage the upper end of jacket 83 to limit downward movement of press ring 93 into the top of annular chamber 42. The upper end of the jacket 83 is reinforced with an annular collar or sleeve 100.

Ring 91 is movable to a raised position, as shown in FIG. 3, to permit the concrete 83 to move into the annular space between the core wall 51 and the jacket wall 83 and to a lowered or compressing position, as shown in FIG. 6. A pair of hydraulic cylinders 101 and 103 function to selectively raise and lower the press ring 93. A piston rod 102 connects cylinder 101 to ring 91. In a similar manner, a piston rod 104 connects cylinder 103 to an opposite side of ring 91. Additional cylinders can be used to control the position of the ring 91 thereby controlling the location of the press ring 93. Other types of structures can be used to selectively raise and lower the press ring 93. Vibrators (not shown) can be mounted on ring 91 and operated to facilitate the densification of the concrete in the upper end of the pipe.

Returning to FIG. 6, an annular header 106 surrounds the upper end of core wall 51 and header 106 has an outwardly directed annular flange 107 located in general horizontal alignment with the annular top member 62 of the core. Header 106 centrally positions the pipe socket sleeve 108 around core wall 51. A reinforcing cage 109 is secured to sleeve 108 and extends downwardly to the socket sleeve 111. As shown in FIG. 3, socket sleeve 111 is located in a step pallet or tongue former 112 resting on filler plate 88.

Returning to FIG. 3, a first vibrator 113 is secured to the top box member 52. A second lower vibrator 114 is secured to the lower box member 54. The vibrators are electrically driven vibrator units that function to apply vibratory movements to the cylindrical wall 51. Additional vibrators can be mounted on the cylindrical wall 83 of the outer jacket 41.

In use, the outer jacket 41 is located on the filler plate 88 around the tongue former 112 and circular reinforcing cage 109. The turntable 21 is then turned to move the jacket 41 in a position wherein the upright axis of the jacket coincides with the axis of shaft 37 and core 51. Core 39 is in the elevated or up position as shown in FIG. 2. Cross head 32 is lowered thereby lowering core 39 into the jacket 41 until the bottom of the core rests on turntable 21. The shaft 37 is moved a short distance downwardly to separate the cap 71 from the collar 67. Core 39 is supported in upright position on the resilient cushion ring 74. Shaft 37 is free to rotate without rotating core 39.

The concrete 47 is moved by conveyor 46 to the top of core 39. The motor 35 on cross head 32 is operated to rotate shaft 37 thereby turning arms 78 and 79. The concrete on the top plate 59 is moved by arms 78, 79 into the chamber between the inner core wall 51 and the jacket wall 83. During the filling of this annular chamber, the vibrators 113 and 114 operate to densify the concrete to minimize the voids between the concrete and the wires of the reinforcing cage 109. The lower vibrators are first operated as the bottom of the pipe is formed. As the level of concrete rises, additional vibrators are started until the pipe is completed.

When the annular chamber is full, conveyor 46 is stopped and moved to its retracted position. The hydraulic cylinders 101 and 102 are operated to lower the press ring 93 to its lower compressing position as shown in FIG. 6. The upper part of the concrete is forced downwardly and around the lower edge of the sleeve 108 into the space below the header 106 as indicated by arrow 116 in FIG. 6. The air in the space between sleeve 108 and wall 51 freely escapes upwardly through the annular space 117 between header 106 and wall 51. Press ring 93 is moved down into the concrete in the upper end of the pipe until stops 99 engage the top of jacket 41. The hydraulic cylinders 101 and 103 are then retracted to move the press ring and cylindrical member 92 to the up position. The power head 32 is then moved to the raised position by operation of hydraulic cylinders 34 and 36, thereby moving core 39 to its elevated position as shown in FIG. 2. The pipe 118 remains in jacket 41. Turntable 21 is then rotated to move the jacket and pipe from the pipe making station of the machine to the outside station where they can be transported to a curing and stripping location.

A new jacket, tongue former, reinforcing cage and pallet located on the turntable are moved into the longitudinal upright alignment with the raised core. The process is repeated to make a second pipe.

An example of a machine and method for making dry cast concrete pipe has been shown and described. Changes, additions, and modifications of the machine may be made by those skilled in the art without departing from the invention.

We claim:

1. An apparatus for making dry cast concrete product comprising: an upright frame, a cross head movably mounted relative to said frame for movement between a down position and an up position, a rotatable shaft connected to the cross head and movable with the cross head, said shaft extended downwardly from the cross head, said cross head having drive means for rotating the shaft, an upright core supported on a support when the cross head is in the down position, said shaft extended downwardly into the core, said core and shaft having cooperating means for allowing the shaft to rotate independent of the core when the cross head is in the down position and for moving the core upwardly with the shaft whereby the core is lifted by the shaft in reponse to movement of the cross head from its down position to the up position, a jacket surrounding the core mounted on a support, said jacket being spaced from the core defining a chamber between the core and jacket, means closing the top of the core, means for moving concrete to the top of the core, at least one arm secured to the shaft, said arm located above the core and operable on rotation of the shaft to move concrete from the top of the core to the chamber, and means for moving the cross head from the down position to the up position whereby the core is withdrawn from the concrete product formed in the chamber between the core and jacket.

2. The apparatus of claim 1 wherein: the core has a cylindrical outer wall, a plurality of tubular members located along the longitudinal axis of the wall, said tubular members having aligned passages accommodating the shaft, and a plurality of plates securing the tubular members to the wall, said cooperating means including first means secured to the shaft and second means secured to one of the tubular members, said first means being engageable with the second means when the core is lifted by the shaft.

3. The apparatus of claim 2 wherein: the first means secured to the shaft is a cap member attached to the lower end of the shaft, said cap member being located out of engagement with the second means when the cross head is in the down position and engageable with said second means when the cross head is moved from the down position to the up position.

4. The apparatus of claim 2 including: vibrator means secured to at least one tubular member for vibrating the wall.

5. The apparatus of claim 1 wherein: the core has a continuous upright wall, a plate mounted on the upper end of the wall to close the upper end of the core, part of said cooperating means being secured to the inside of the upright wall.

6. The apparatus of claim 1 wherein: the cooperating means includes a member having a passage through which the shaft projects, and first means mounted on the shaft engageable with the member when the cross head is moved from the down position to the up position to withdraw the core from the jacket.

7. The apparatus of claim 6 wherein: the first means mounted on the shaft is a cap member secured to the lower end of the shaft.

8. The apparatus of claim 1 including: resilient means secured to the core and engageable with the support to yieldably mount the core on the support.

9. The apparatus of claim 8 wherein: the resilient means is a ring of resilient material attached to the lower end of the core.

10. The apparatus of claim 1 including: an annular ring located above the upper end of jacket, annular means secured to the ring, and means operable to move the annular means into the upper portion of the chamber between the core and jacket to compress the concrete in said upper portion of the chamber between the ore and jacket.

11. The apparatus of claim 10 including: stop means secured to the ring engageable with the upper end of the jacket to limit movement of the annular means into the chamber.

12. The apparatus of claim 10 including: a sleeve secured to the ring and extended around the upper end of the jacket.

13. The apparatus of claim 1 including: an annular ring having a central opening aligned with the upper end of the core, a sleeve secured to the ring and extended downwardly therefrom around the upper end of the jacket, annular means mounted on the ring aligned with the upper end of the chamber between the core and jacket, stop means secured to the ring and engageable with the upper end of the jacket to limit downward movement of the annular means into the chamber, and means operable to move the annular means into the upper end of the chamber to compress the concrete in said upper end of the chamber.

14. The apparatus of claim 1 wherein: a plurality of arms are secured to the shaft for moving concrete from the top of the core to the chamber between the core and jacket.

15. An apparatus for making a dry cast concrete pipe comprising: an upright frame, upright guide members mounted on the frame, a cross head movably mounted on the guide members for movement from a down position to an up position, means connected to the cross member and frame operable to selectively move the cross head between the down and up positions, a rotatable shaft mounted on the cross head, said shaft extended downwardly from and movable with the cross head, said cross head having drive means for rotating the shaft, a turntable located at the lower portion of the frame, an upright core positionable on the turntable when the cross head is in the down position, said core having a side wall, a top wall, and said core and shaft having cooperating means for allowing the shaft to rotate independent of the core and for moving the core upwardly with the shaft whereby the core is lifted by the shaft in response to movement of the cross head from the down position to the up position thereof, a jacket surrounding the core, said jacket having an upright wall spaced from the side wall of the core forming a chamber for receiving concrete, means for moving concrete to the top of the core, at least one arm secured to the shaft above the top wall of the core, said arm being rotated with the shaft to move concrete from the top of the core into the chamber whereby the concrete forms a pipe in the chamber between the jacket and the side wall of the core.

16. The apparatus of claim 15 wherein: the core has a plurality of tubular members located along the longitudinal axis of the side wall, said tubular members having aligned passages for accommodating the shaft, and means securing the tubular members to the side wall, said cooperating means including first means secured to the shaft, and second means secured to one of the tubular members, said first means engageable with the second means on movement of the cross head from the down position to the up position.

17. The apparatus of claim 16 wherein: the first means secured to the shaft has a cap member attached at the lower end of the shaft, said cap member being located out of engagement with the second means when the cross head is in the down position and engageable with said second means when the cross head is moved from the down position to the up position.

18. The apparatus of claim 16 including: vibrator means secured to at least one of the tubular members for vibrating the side wall.

19. The apparatus of claim 15 wherein: the cooperating means includes a member having a passage through which the shaft projects, means securing the member to the side wall of the core, and means mounted on the shaft engageable with the member when the cross head is moved from the down position to the up position to withdraw the core from the jacket.

20. The apparatus of claim 19 wherein: the means mounted on the shaft is a cap member secured to the lower end of the shaft.

21. The apparatus of claim 15 including: resilient means secured to the core and engageable with the turntable to yieldably mount the core on the turntable when the cross head is in the down position.

22. The apparatus of claim 21 wherein: the resilient means is a ring of resilient material attached to the lower end of the core.

23. The apparatus of claim 15 wherein: a plurality of arms are secured to the shaft for moving concrete from the top of the core to the chamber between the core and the jacket.

24. The apparatus of claim 15 including: an annular ring located above the upper end of jacket, annular means secured to the ring, and means operable to move the annular means into the upper portion of the chamber between the core and jacket to compress the concrete in said upper portion of the chamber between the core and jacket.

25. The apparatus of claim 24 including: stop means secured to the ring engageable with the upper end of the jacket to limit movement of the annular means into the chamber.

26. The apparatus of claim 24 including: a sleeve secured to the ring and extended around the upper end of the jacket.

27. The apparatus of claim 15 including: an annular ring having a central opening aligned with the upper end of the core, a sleeve secured to the ring and extended downwardly therefrom around the upper end of the jacket, annular means mounted on the ring aligned with the upper end of the chamber between the core and jacket, stop means secured to the ring and engageable with the upper end of the jacket to limit downward movement of the annular means into the chamber, and means operable to move the annular means into the upper end of the chamber to compress the concrete in said upper end of the chamber.

28. An apparatus for making dry cast concrete product comprising: a frame, a cross head movably mounted relative to said frame for movement between a down position and an up position, a rotatable shaft connected to the cross head, said shaft extended downwardly from the cross head, said cross head having drive means for rotating the shaft, an upright core supported on a support when the cross head is in the down position, said shaft extended downwardly into the core, said core and shaft having cooperating means for allowing the shaft to rotate independent of the core and for moving the core upwardly with the shaft whereby the core is lifted by the shaft in response to movement of the cross head from its down position to the up position, a jacket surrounding the core mounted on a support, said jacket being spaced from the core defining a chamber between the core and jacket, means connected to the shaft for rotation therewith for moving concrete from the core to the chamber to fill the chamber with concrete, and means for moving the cross head from the down position to the up position whereby the core is withdrawn from the concrete product formed in the chamber between the core and jacket.

29. The apparatus of claim 28 wherein: the core has a cylindrical outer wall, a plurality of tubular members located along the longitudinal axis of the wall, said tubular members having aligned passages accommodating the shaft, and a plurality of plates securing the tubular members to the wall, said cooperating means including first means secured to the shaft, and second means secured to the core.

30. The apparatus of claim 29 wherein: the first means secured to the shaft is a cap member attached to the lower end of the shaft, said cap member being located out of engagement with the second means when the cross head is in the down position and engageable with said second means when the cross head is moved from the down position to the up position.

31. The apparatus of claim 28 wherein: the core has a continuous upright wall, a plate mounted on the upper end of the wall to close the upper end of the core, part of said cooperating means being secured to the inside of the upright wall.

32. The apparatus of claim 28 wherein: the cooperating means includes a member having a passage through which the shaft projects, and first means mounted on the shaft engageable with the member when the cross head is moved from the down position to the up position to withdraw the core from the jacket.

33. The apparatus of claim 28 including: resilient means secured to the core and engageable with the suppport to yieldably mount the core on the support.

34. The apparatus of claim 28 including: an annular ring located above the upper end of jacket, annular means secured to the ring, and means operable to move the annular means into the upper portion of the chamber between the core and jacket to compress the concrete in said upper portion of the chamber between the core and jacket.

35. The apparatus of claim 34 including: stop means secured to the ring engageable with the upper end of the jacket to limit movement of the annular means into the chamber.

36. The apparatus of claim 34 including: a sleeve secured to the ring and extended around the upper end of the jacket.

37. The apparatus of claim 28 including: an annular ring having a central opening aligned with the upper end of the core, a sleeve secured to the ring and extended downwardly therefrom around the upper end of the jacket, annular means mounted on the ring aligned with the upper end of the chamber between the core and jacket, stop means secured to the ring and engageable with the upper end of the jacket to limit downward movement of the annular means into the chamber, and means operable to move the annular means into the upper end of the chamber to compress the concrete in said upper end of the chamber.

38. An apparatus for making dry cast concrete product comprising: a frame, a cross head movably mounted relative to said frame for movement between a down position and an up position, downwardly extended means connected to the cross head and movable up and down with the cross head, an upright core supported on a support when the cross head is in the down position, said downwardly extended means extended into said core, said core and downwardly extended means having cooperating means for allowing the core to be disengaged from the downwardly extended means when the cross head is in the down position and for moving the core upwardly with the downwardly extended means whereby the core is lifted by the downwardly extended means in response to movement of the cross head from its down position to the up position, a jacket surrounding the core mounted on a support, said jacket being spaced from the core defining a chamber between the core and jacket for accommodating concrete, and means for moving the cross head from the down position to the up position whereby the core is withdrawn from the jacket and concrete product formed in the chamber between the core and jacket.

39. The apparatus of claim 38 wherein: said cooperating means includes first means secured to the downwardly extended means and second means secured to the core, said first means being engageable with the second means when the core is lifted in response to upward movement of the cross head.

40. The apparatus of claim 39 wherein: the first means is a cap member attached to a lower portion of the downwardly extended means, said cap member being located out of engagement with the second means when the cross head is in the down position and engageable with the second means when the cross head is moved from the down position to the up position.

41. The apparatus of claim 38 including: resilient means secured to the core and engageable with the support to yieldably mount the core on the support.

42. The apparatus of claim 38 including: an annular ring located above the upper end of the jacket, annular means secured to the ring, and means operable to move the annular means into the upper portion of the chamber between the core and jacket to compress the concrete in said upper portion of the chamber between the core and jacket.

43. The apparatus of claim 42 including: stop means secured to the ring and engageable with the upper end of the jacket to limit movement of the annular means into the chamber.

44. The apparatus of claim 42 including: a sleeve secured to the ring and extended around the upper end of the jacket.

45. The apparatus of claim 38 including: an annular ring having a central opening aligned with the upper end of the core, a sleeve secured to the ring and extended downwardly therefrom around the upper end of the jacket, annular means mounted on the ring aligned with the upper end of the chamber between the core and jacket, stop means secured to the ring and engageable with the upper end of the jacket to limit downward movement of the annular means into the chamber, and means operable to move the annular means into the upper end of the chamber to compress concrete in the upper end of the chamber.

46. The apparatus of claim 38 wherein: said core has a top wall, said downwardly extended means including rotatable means, said cross head having means to rotate said rotatable means, means attached to the rotatable means located adjacent said top wall of the core to move concrete from the top wall of the core into the chamber in response to rotation of the rotatable means.

47. The apparatus of claim 46 wherein: the means for moving the concrete from the top wall of the core into the chamber includes a plurality of arms located adjacent said top wall, said arms being secured to said rotatable means for moving concrete from the top wall into the chamber between the core and jacket.

* * * * *